US006088553A

United States Patent [19]

Kuwata et al.

[11] Patent Number: 6,088,553

[45] Date of Patent: Jul. 11, 2000

[54] IMAGE FORMING APPARATUS

[75] Inventors: Takashi Kuwata, Numazu; Yuzo Isoda, Susono; Yasuhiro Uchida; Makoto Izumi, both of Shizuoka-ken, all of Japan

[73] Assignee: Canon Kabushiki Kaisha, Tokyo, Japan

[21] Appl. No.: 09/310,853

[22] Filed: May 13, 1999

[30] Foreign Application Priority Data

May 18, 1998 [JP] Japan ..... 10-134822

[51] Int. Cl.[7] ..... G03G 15/00; G03G 15/20

[52] U.S. Cl. ..... 399/107; 399/37; 399/88; 399/124

[58] Field of Search ..... 399/88, 89, 90, 399/9, 11, 37, 107, 124; 347/237, 247; 358/474

[56] References Cited

U.S. PATENT DOCUMENTS

| | | | |
|---|---|---|---|
| 4,166,692 | 9/1979 | Okada et al. | 399/107 |
| 5,017,958 | 5/1991 | Katoh | 399/18 |
| 5,144,384 | 9/1992 | Fujita et al. | 399/19 |

*Primary Examiner*—Matthew S. Smith
*Assistant Examiner*—Hoang Ngo
*Attorney, Agent, or Firm*—Fitzpatrick, Cella, Harper & Scinto

[57] ABSTRACT

An image forming apparatus capable of preventing the return of a power supply switch from being forgotten and eliminating the troubles due to the forgetting of this return and having a sheet processing device attached to the main body thereof. The sheet processing device includes a driving source for actuating the sheet processing device, a power supply for supplying the power to the driving source and a switch for the switching of the power supply to ON/OFF, wherein the switch becomes switchable to ON condition on detaching the outer cover of the sheet processing device and is switched to OFF condition on attaching the outer cover.

15 Claims, 7 Drawing Sheets

CONDITION OF SLIDE SWITCH

IMAGE FORMING APPARATUS

BACKGROUND OF THE INVENTION

1. Field of the Invention

The present invention relates to a sheet processing device detachably attachable to an image forming apparatus such as printer, facsimile or copier, e.g. to a sheet processing device for feeding a sheet such as original or recording paper to an image forming apparatus or for giving a predetermined processing to a sheet discharged from the image forming apparatus.

2. Related Background Art

In recent years, the image forming apparatus such as printer or copier has advanced in speed-up and networking. Often in such an image forming apparatus, various sheet processing devices (such as devices for feeding a sheet to the main body of the image forming apparatus or devices for giving a predetermined processing to a sheet discharged from the main body of the image forming apparatus) satisfying the need for promoting user's convenience are so configured as detachably attachable. Not only do some of these sheet processing devices have a configuration that power is supplied from a power supply in the main body of the image forming apparatus, but others have the power supply in themselves. From the standpoint of saving the power consumption, some of the power-supply equipped sheet processing devices switch the power supply to ON or OFF under remote control of the main body of the image forming apparatus to save the power when the main body of the image forming apparatus does not operate.

In cases where expendable parts are exhausted to the utmost of their service life or a sheet processing device itself fails, a sheet processing device as mentioned above is required to check for operation in a single unit of processing device alone by a service man after the replacement or repair of parts.

Because of being controlled remotely from the main body of an image forming apparatus, however, the power supply mounted on a sheet processing device could not be turned ON in a detached condition from the main body of the image forming apparatus, i.e. in the condition of single separate unit. In consequence, so as to check the operation of the device there was an inconvenience that a service man had to carry a power supply capable of turning ON or OFF as a single unit to the installing position of a processor to connect with the device.

Thus, there were sheet processing devices equipped with a switch switchable to ON or OFF of a power supply as a single unit, but such a power supply had a fear that the service man might forget to return the switch to OFF after switching it to ON to check for operation in a single unit. In such cases, since the power supply of a sheet processing device that should be OFF in itself was ON, communication with the main body of the image forming apparatus may come into the isolated condition and a normal use of the processing device was disabled.

Additionally, the power source of the sheet processing device remained ON even when the main body of the image forming apparatus does not operate, thereby resulting not only in a wasteful consumption of power but also in a shorter service life of the power supply or other electric parts.

SUMMARY OF THE INVENTION

Thus, it is one object of the present invention to prevent the return of the power supply switch from being forgotten and eliminate the inconveniences due to this neglect of return.

And, it is another object of the present invention to provide an image forming apparatus with a sheet processing device attached to the main body of the image forming apparatus, the sheet processing device comprising a driving source for actuating the sheet processing device, a power supply for supplying the power to the driving source and a switch for the switching of the power supply to ON/OFF wherein the switch becomes switchable to ON on detaching the outer cover of the sheet processing device and turns OFF on attaching the outer cover.

And, it is a further object of the present invention to provide an image forming apparatus with a detachable sheet processing device attached to the main body of the image forming apparatus, the sheet processing device comprising a driving source for actuating the sheet processing device, a power supply for supplying the power to the driving source and a switch for the switching of the power supply to ON/OFF wherein the switch becomes switchable to ON on detaching the sheet processing device from the main body of the image forming apparatus and is switched to OFF on attaching the sheet processing device to the main apparatus body.

And, it is yet another object of the present invention to provide an image forming apparatus with a sheet processing device attached to the main body of the image forming apparatus, the sheet processing device comprising a driving source for actuating the sheet processing device, a power supply for supplying the power to the driving source and a switch for the switching of the power supply to ON/OFF wherein the power supply is provided dismountably from the main body of the sheet processing device and the switch becomes switchable to ON on dismounting the power supply and the power supply becomes mountable onto the main processor body on switching the power supply switch to OFF.

DESCRIPTION OF THE PREFERRED EMBODIMENTS

Figure 1:
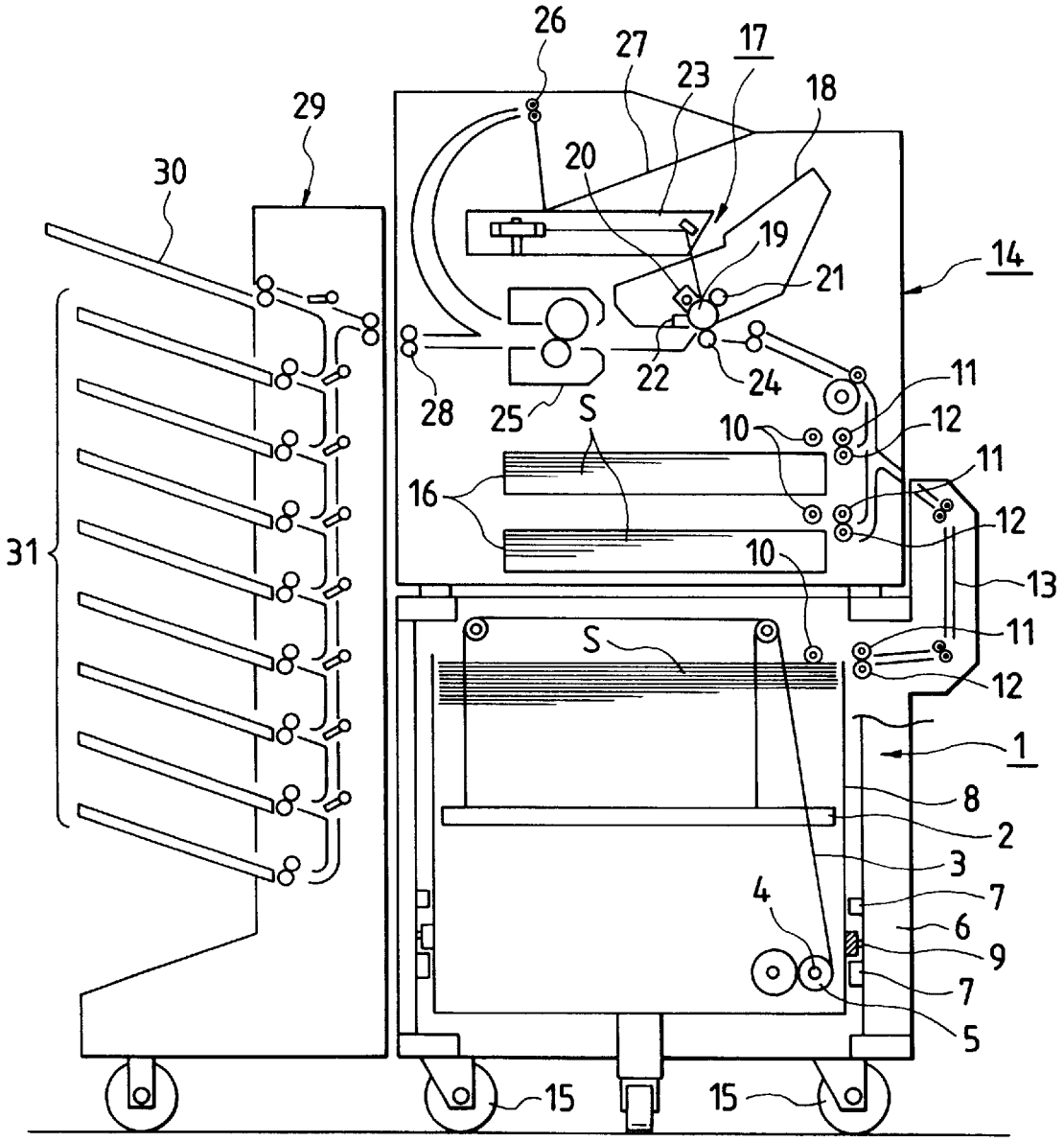
FIG. 1 is a longitudinal sectional view showing the outline configuration of the whole printer with a deck and a finisher attached.

Hereinafter, referring to the drawings, embodiments of sheet processing devices and image forming apparatuses to which the present invention is applied will be described specifically.

A sheet processing device and an image forming apparatus according to Embodiment 1 will be specifically described by referring to the drawings. Incidentally, in this embodiment, a description is made to exemplify a laser beam printer as image forming apparatus and further a deck and a finisher linked to the main body of a printer as sheet processing device.

The outline configuration of the whole printer will be described by using FIG. 1. FIG. 1 is a longitudinal sectional view of a printer with a deck and a finisher mounted.

First, the outline configuration of a deck 1 will be described. As shown in FIG. 1, a sheet stack plate 2 is hung up at four corners with wire ropes 3 and the wire ropes 3 are so arranged as capable of being wound and rewound by the rotation of a winding winch 5 fastened to a winding shaft 4. Incidentally, though unshown, a driving unit equipped with a motor and a one-way clutch is provided connectably to a connecting gear fixed at the winding shaft 4.

With a rail 7 provided in the main body frame 6 of the deck 1 and a rail 9 provided in the sheet stack unit 8, the sheet stack unit 8 can be drawn out toward this side of FIG. 1 relative to the main body of the deck. By drawing out this sheet stack unit 8, the connection between the connecting gear of the above winding shaft 4 and the driving unit is released and the sheet stack plate 2 descends while rewinding the wire rope 3 wound around the winding winch 5 by the self weight (and weight of the stacked sheets), thus enabling the supplement of sheets S.

Incidentally, to soften the shock received by the sheet stack unit 8 during the descent of the above sheet stack plate 2, the winding shaft 4 is equipped with a brake damper unshown.

Additionally, in accordance with a detection signal of unshown detecting means such as sheet surface sensor for detecting the top surface, a motor in the driving unit is driven so as to keep the top surface of the sheet S stacked on the sheet stack plate 2 nearly at a constant position while raising the sheet stack plate 2.

Above the sheet stack unit 8, a pickup roller 10 as feeding means for feeding out the sheets S stacked on the sheet stack plate 2, and a field roller 11 and a retard roller 12 constituting reversal separating means for separating the sheet S fed out by the pickup roller 10 are provided. And, the pickup roller 10 feeds out a sheet S by sliding contact with the top surface of the sheet S kept nearly at a constant position and the reversal separating means separates only the uppermost sheet among the sheet S fed out by the pickup roller 10. Then, the separated sheet S is sent to the main body 14 of the printer via a conveying path 13.

Here, the outline configuration of the main body 14 of the printer to which the deck 1 is linked will be described. Incidentally, the deck 1 serves also as a rack for mounting the main body 14 of the printer and sheets S fed out from the deck 1 are fed to the main body 14 of the printer through the conveying path 13 provided on the side. Additionally, below the deck 1, casters 15 are attached to facilitate movement when the main body 14 of the printer is mounted.

The main body 14 of the printer is equipped with front floating type sheet cassette(s) 16 (two cassettes in this embodiments) mounted from the front. The sheets S housed in individual sheet cassettes 16 are separated selectively one by one and fed out by a pickup roller 10, a feed roller 11 and a retard roller 12, same as the deck 1. On sheets S selectively fed out from the this sheet cassette 16 or the above deck 1, an image is formed at the image forming section 17 in the main body 14 of the printer.

The image forming section 17 has a process cartridge 18 detachably attachable to the main body 14 of the printer. In this process cartridge 18, an electrophotographic photosensitive drum 19 as image bearing member, charging means 20 for charging the surface of the photosensitive drum 19, developing means 21 for forming a toner image on the photosensitive drum 19, cleaning means 22 for removing the toner image remaining on the surface of the photosensitive drum 19 and suchlike are integrally provided. Incidentally, the photosensitive drum 19 is exposed by image light irradiated from the scanner section 23 in accordance with an image signal, so that a latent image for forming the above toner image is formed.

Additionally, the image forming section 17 is equipped with a transfer roller 24 for transferring the toner image formed on the surface of the photosensitive drum 19 to the sheet S. While pressing the sheet S selectively fed out from the sheet cassette 16 or the deck 1 onto the photosensitive drum 19, this transfer roller 24 transfers the toner image on the drum surface to the sheet S under application of a voltage inverse in polarity to the toner image on the drum surface.

Furthermore, on the side downstream of the image forming section 17, fixing means 25 for fixing a transfered image to the above sheet S is provided. Accordingly, the toner image transferred to the sheet at the image forming section 17 is fixed under heat and pressure applied by this fixing means 25. And, the sheet S on which the toner image has been fixed is discharged by a pair of discharge rollers 26 to the discharge tray 27 provided at the upper portion of the main body 14 of the printer or discharged by a pair of discharge rollers 28 to the finisher 29 connected to the side portion of the main body 14 of the printer.

In the finisher 29, to direct or reverse the image surface to the lower side (face down) on the tray, the sheet S discharged from the main body 14 of the printer is switched back on the switchback tray 30 to stack to one of the discharge trays 31 with the image surface of the sheet S brought into the lower side.

Figure 2:
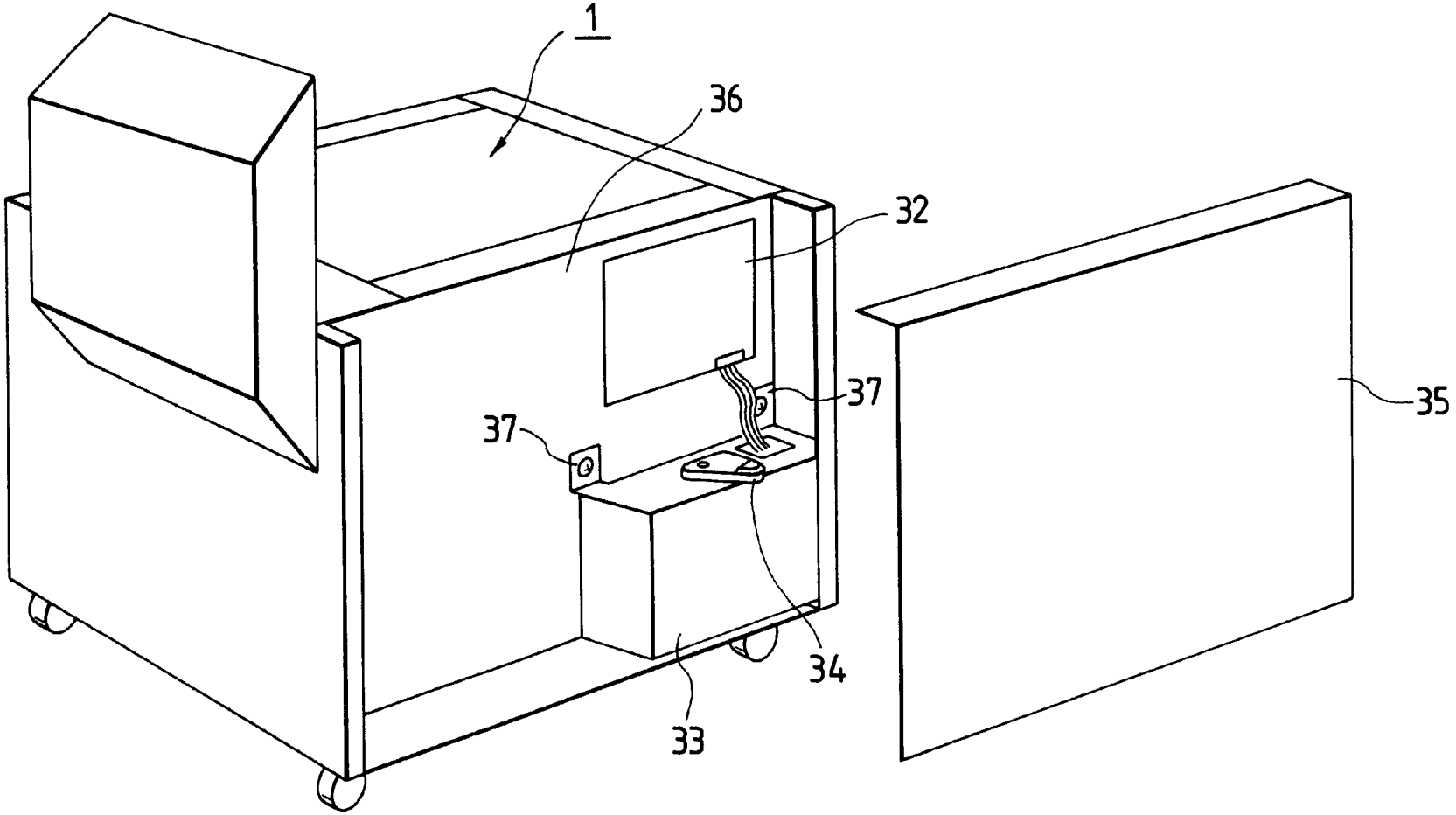
FIG. 2 is a schematic view of a deck according to Embodiment 1 with the rear cover detached.
Figure 3A:
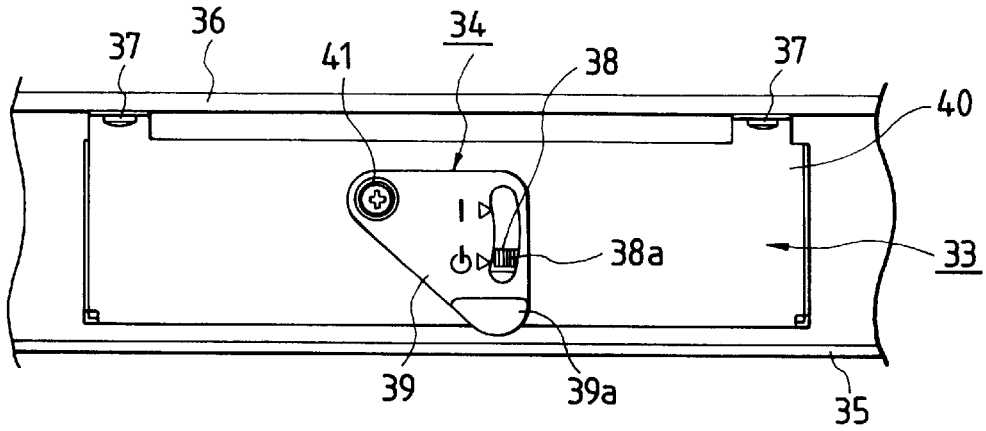
FIGS. 3A, 3B and 3C are schematic views of the power supply switches of a deck according to Embodiment 1.
Figure 3B:
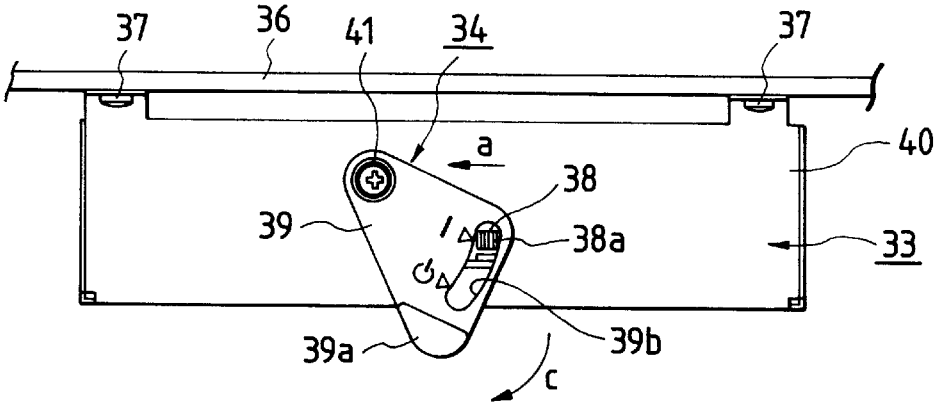

Next, by using FIGS. 2 to 4, the configuration of a deck to which the present invention is applied will be described in further detail. FIG. 2 is a schematic view of a deck with the rear cover detached. FIGS. 3A, 3B and 3C are schematic views of the power supply switches of a deck. FIG. 4 is a view showing the relationship between the ON/OFF condition of a power supply and the slide (move) amount of a power supply switch. Incidentally, in FIG. 2, Numeral 32 denotes a controller.

In addition to the above configuration, a deck 1 according to this Embodiment is equipped with a power supply 33 that can be turned ON by an instruction from the main body 14 of the printer and a switch 34 for the switching of the power supply 33 to ON/OFF.

As shown in FIG. 2, the power supply 33 is positioned inside of the attachable/detachable rear cover 35 serving for an outer casing of the deck 1 and fastened with machine screws 37 to the apparatus case 36. Accordingly, a service man, for example, is so arranged as to switch the switch 34 of the power supply 33 to ON after detaching the rear cover 35 from the apparatus case 36. As shown in FIG. 3, the switch 34 comprises a slide switch 38 equipped in an unshown power supply basis and a switch lever 39 for sliding the slide switch 38 in the ON/OFF direction (in FIGS. 3A to 3C, arrowhead a/b direction). The slide section 38*a* of the above slide switch 38 is exposed from the power supply chassis 40 and inserted into a guide section 39*b* comprising the slit of the switch lever 39 fixed rotatably only within the range of a constant angle around the stepped screw 41 to the power supply chassis 40.

And, the switch 34 is so arranged as to become capable of turning the power supply 33 ON when the rear cover 35 serving as an outer cover of the device is detached, and as to turn OFF the power supply 33 when the rear cover 35 is attached. Hereinafter, manipulating the switch 34 of the power supply 33 will be described.

First, detaching the rear cover 35 from the apparatus case 36, as shown in FIG. 2, leads to the condition capable of drawing out the switch lever 39, or that capable of turning ON the power supply 33. And, the knob part 39*a* of the switch lever 39 is drawn out by hooding with fingers from the OFF condition (home position) shown in FIG. 3A to this side with fingers and the switch lever 39 is rotated clockwise (in FIG. 3B, arrowhead c direction) around the stepped screw 41 as shown in FIG. 3B. By this rotating action, the guide part 39*b* of the switch lever 39 abuts against the right side wall of the slide part 38*a* of the slide switch 38 and the slide switch 38 begins to slide from the OFF condition toward the ON condition (in FIG. 3B, arrowhead a direction). And, the slide part 38*a* of the slide switch 38 moves to the movable limit position in the state where the switch lever 39 is fully drawn out, and the power supply 33 turns to ON condition. And, with the switch lever 39 brought into the fully drawn condition, the know part 39*a* of the switch lever 39 stands at the position (as shown in FIG. 3B) of greatly protruding outward from the attaching position of the rear cover 35 (position shown in FIG. 3A).

Figure 3C:
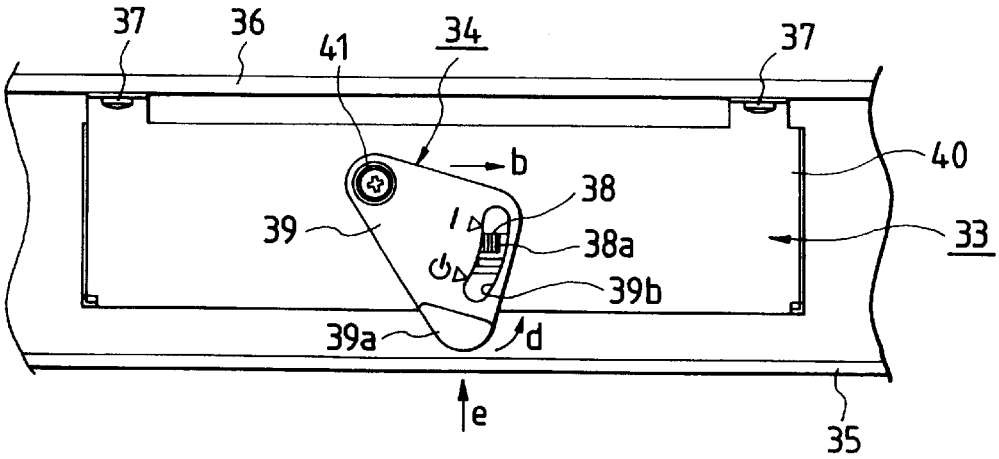
Figure 4:
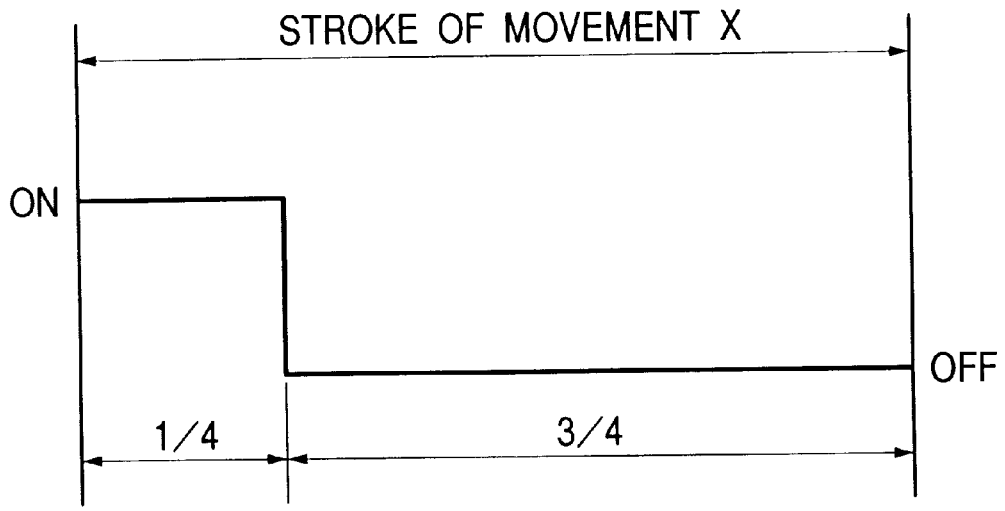
FIG. 4 is a view showing the relationship between the ON/OFF condition of a power supply and a slide amount of a power supply switch.

In turning OFF the power supply 33, the knob part 39*a* of the switch lever 39 is rotated counterclockwise (in FIG. 3C, arrowhead d) by the push of fingers as shown in FIG. 3C. By this rotating action, the left side wall of the guide part 39*b* of the switch lever 39 abuts against the slide part 38*a* of the slide switch 38 and the slide switch 38 begins to slide from ON condition to OFF condition (in FIG. 3C, arrowhead b direction). And, with the switch lever 39 brought into the completely returned condition, the knob part 39*a* of the switch lever 39 stops at the position of sliding more than half of the work region as shown in FIG. 3C. Then, the detached rear cover 35 is attached to the apparatus case 36.

Incidentally, since the slide switch 38 employed here is so arranged that about ¼ of the work region stands for ON condition and about ¾ stands for OFF condition as shown in FIG. 4, more-than-half movement of the slide switch 38 in work region leads to the OFF condition. At a position of OFF condition (home position) as this normal usage condition, since no force is applied to the slide switch 38, no stress whatever is laid on the unshown power supply basis in which the slide switch 38 is mounted.

Additionally, when an attempt is made to attach the rear cover 35 in error with the power supply 33 left ON, for example, the inside surface of the rear cover 35 pushes the knob part 39*a* of the switch lever 39 in the direction of turning OFF the power supply 33 (arrowhead e direction) as shown in FIG. 3C. And, when the rear cover 35 reaches to the attaching position (position shown in FIG. 3A), the switch lever 39 returns to the home position or the OFF condition.

By such an arrangement, forgetting the return of the switch 34 of the power supply 33 can be prevented, thus enabling the interruption of communication with the main body of the printer and preventing, a wasteful consumption of power and a shortened service life of electric parts such as power supply.

Incidentally, in this embodiment, the rear cover 35 as outer cover of the main apparatus body made attachable/detachable is employed, but the outer cover is not limited to this arrangement and a cover capable of opening/closing relative to the main apparatus body may be used.

Figure 5:
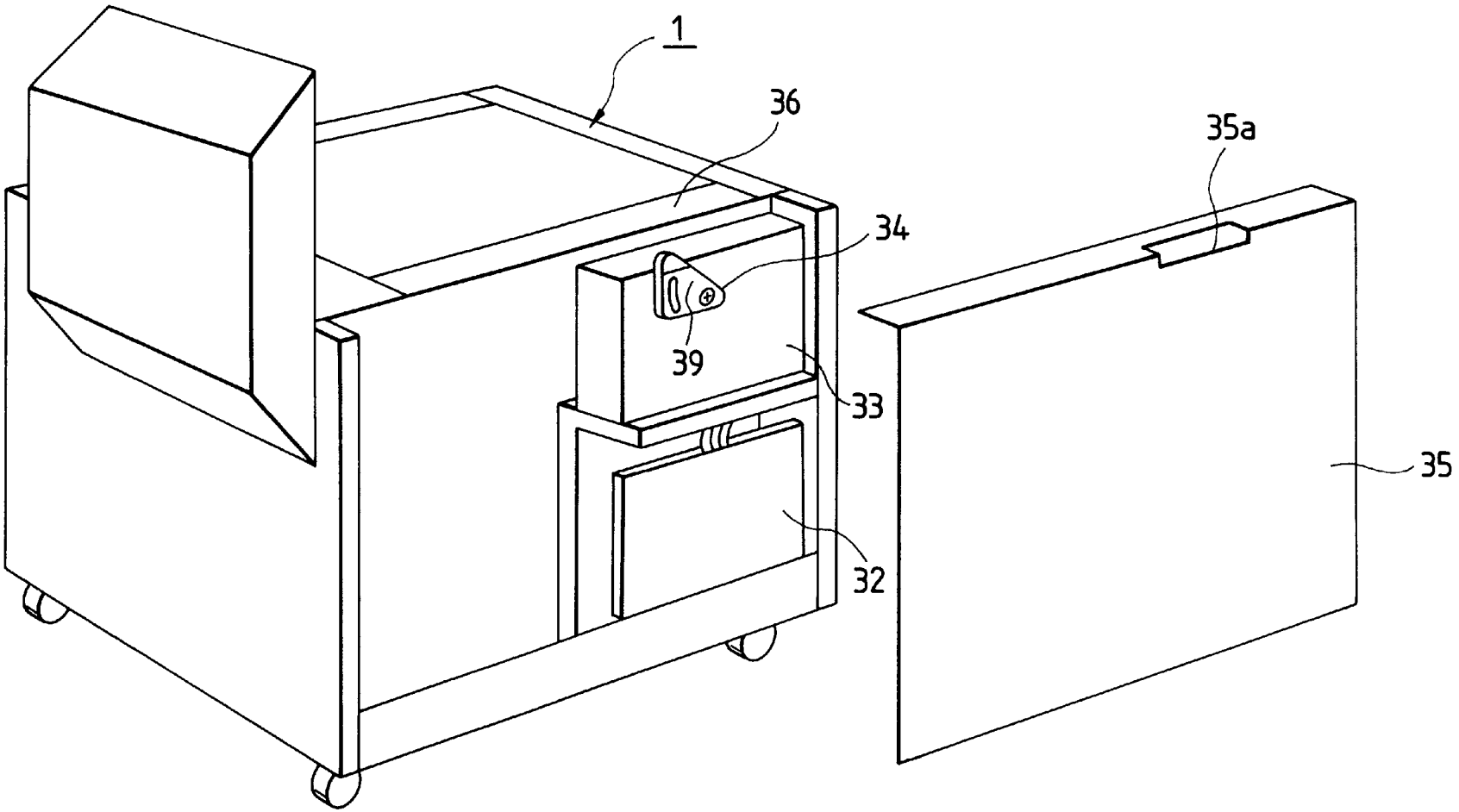
FIG. 5 is a schematic view of a deck according to Embodiment 2 in a condition that the rear cover is detached.
Figure 6B:
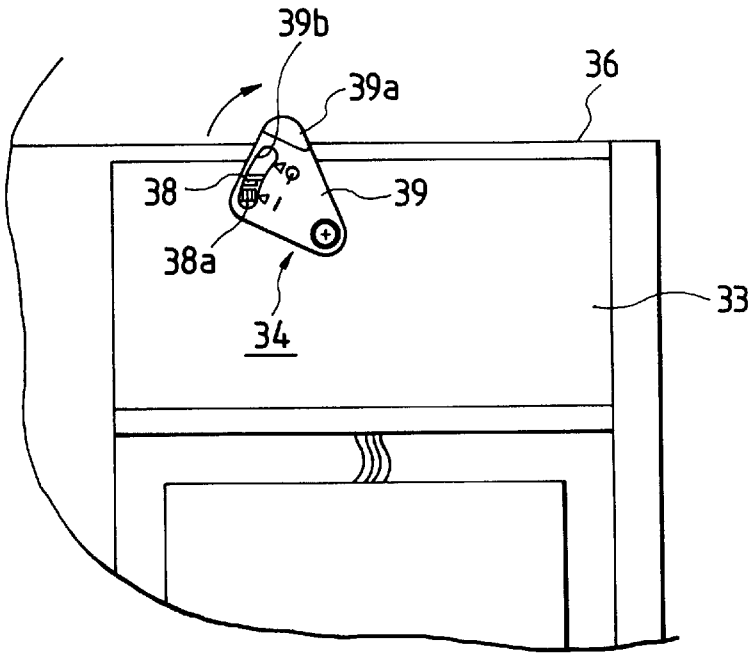
FIGS. 6A and 6B are schematic views of the power supply switches of a deck according to Embodiment 2.
Figure 6A:
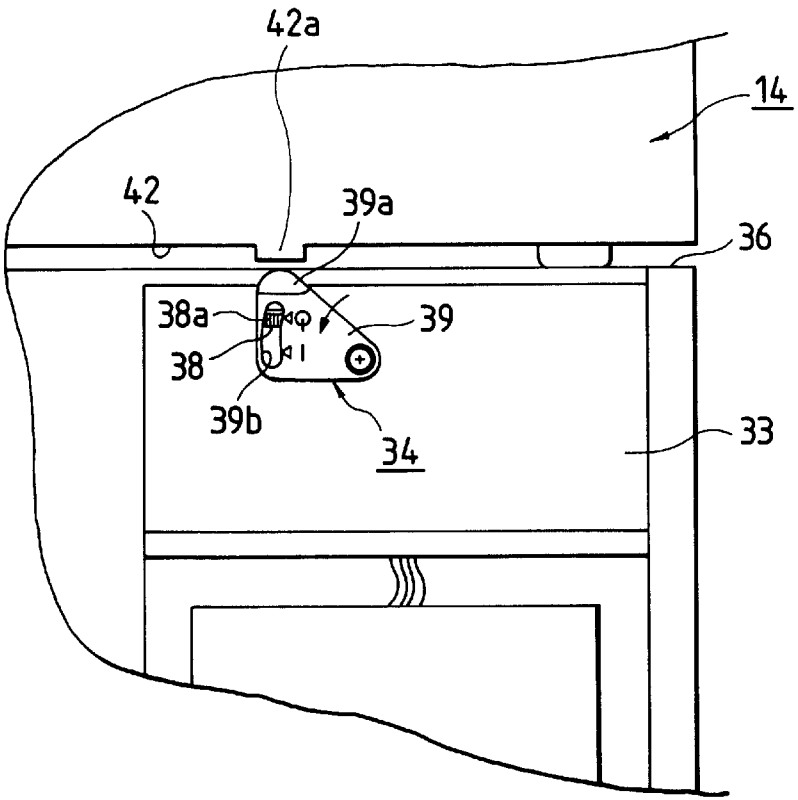

By using FIGS. 5, 6A and 6B, a sheet processing device and an image forming apparatus according to Embodiment 2 will be described in details. FIG. 5 is a schematic view of a deck with the outer cover detached and FIGS. 6A and 6B are schematic views of the power supply switch of a deck. Incidentally, because of a similarity to the configuration of the whole apparatus of Embodiment 1, members equivalent in function are omitted in description with like symbols assigned thereto. Hereinafter, features of this embodiment will be described.

In this Embodiment, the switch 34 is so arranged as to become capable of turning ON the power supply 33 on detaching the deck 1 from the main body 14 of the printer and as to turn OFF the power supply 33 on attaching the deck 1 to the main body 14 of the printer.

Namely, as shown in FIGS. 5, 6A and 6B, the switch lever 39 (knob part 39*a*) constituting the switch 34 is so provided as to protrude from the top surface of the deck 1 serving for stack surface of the main body 14 of the printer in the ON condition. Hereinafter, the manipulation of the switch 34 of a power supply 33 will be described.

First, to turn ON the power supply 33, as shown in FIGS. 6A and 6B, the main body 14 of the printer is dismounted from the deck 1 to make the deck 1 into a single unit and the switch lever 39 is rotated by drawing up the knob part 39*a* thereof exposed from the hole part 35*a* provided in the rear cover 35. By this rotation as with Embodiment 1 mentioned above, the guide part 39*b* moves the slide part 38*a* of the slide switch 38, thus turning ON the power supply 33 (cf. FIG. 6B). Incidentally, in FIGS. 5, 6A and 6B, the condition of detaching the rear cover 35 is illustrated for reason of illustration, but a similar action can be made even in the condition of attaching the rear cover 35.

Besides, when the main body 14 of the printer is loaded on the deck 1 in error with the power supply 33 left ON, for example, the butt surface 42*a* provided on the base plate 42 of the main body 14 of the printer abuts against the knob part 39*a* of the switch lever 39 to rotate the knob part 39*a* of the switch lever 39 in such a direction as to leading to the OFF condition, thereby turning OFF the power supply 33.

According to such an arrangement, as with the embodiment mentioned above, forgetting the return of the switch 34 of the power supply 33 can be prevented, thus enabling the interruption of communication with the main body of the printer, and preventing a wasteful consumption of power and a shortened service life of electric parts such as power supply.

Incidentally, in this Embodiment, an arrangement with the butt surface 42*a* for turning the switch lever 39 of ON condition into the OFF condition provided on the base plate 42 of the main body 14 of the printer is employed, but the present invention is not limited to this arrangement and the switch lever 39 of ON condition may be so arranged as to turn OFF, for example, by using the base plate 42 of the main body 14 of the printer.

Figure 7A:
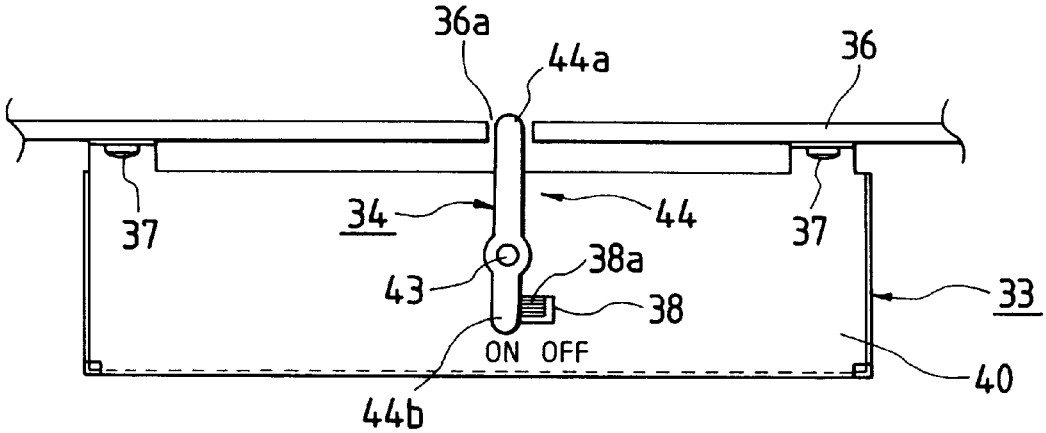
FIGS. 7A and 7B are schematic views of the power supply switches of a deck according to Embodiment 3.
Figure 7B:
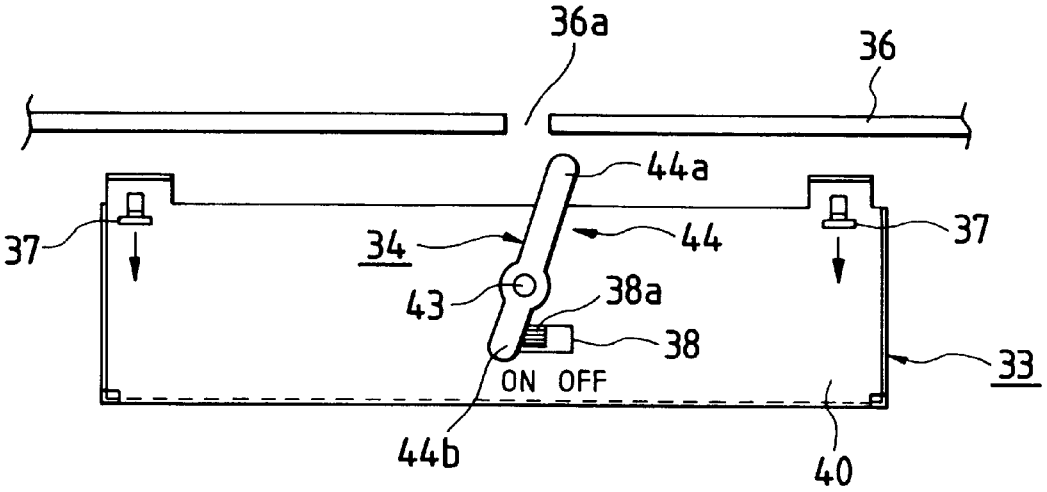

By using FIGS. 7A and 7B, a sheet processing device and an image forming apparatus according to Embodiment 3 will be described in detail. FIGS. 7A and 7B are schematic views of the power supply switches of a deck. Incidentally, since the configuration of the whole apparatus is similar to those of Embodiments 1 and 2, its description is omitted with like symbols assigned to members similar in function. Hereinafter, features of this embodiment will be described.

This embodiment is so arranged that the switch 34 becomes capable of turning a power supply 33 ON when the power supply 33 is dismounted from the apparatus case 36 and the power supply 33 becomes mountable on the apparatus case 36 on switching the switch 34 of the power supply 33 to OFF.

Namely, as shown in FIGS. 7A and 7B, the guide end 44*b* of the switch pin 44 rotatable around the fulcrum 43 abuts against the slide part 38*a* of the slide switch 38. In the condition of the power supply 33 mounted to the apparatus case 36, this switch pin 44 assumes a nearly right angle to the apparatus case 36 as shown in FIG. 7A. In this condition, the knob end 44*a* of the switch pin 44 protrudes from the outer shape of the chassis 40 for the power supply 33 and is inserted in the hole 36a provided on the apparatus case 36. In this condition, the switch 34 of the power supply 33 is OFF.

Next, the manipulation of turning ON the power supply 33 will be described. As shown in FIG. 7B, the machine screws 37 fastening the power supply 33 to the apparatus case 36 are removed to move the power supply 33 in a direction apart from the apparatus case 36 (in FIG. 7B, arrowhead direction) and the slide part 38*a* of the slide switch 38 is slid to achieve the ON condition. At this time, the switch pin 44 is rotated clockwise in coupling with the sliding action of the slide switch 38 and becomes slant to the apparatus case 36. Consequently, if an attempt is made to mount the power supply 33 on the apparatus case 21 in error with the power supply 33 left ON (under the condition shown in FIG. 7B), the power supply 33 cannot be mounted to the apparatus case 36, for the knob end 44*a* of the switch pin 44 cannot be inserted into the hole 36*a* of the apparatus case 36. From the impossibility of mounting the power supply 33 to the apparatus case 36, a service man finds that the switch 34 is positioned at the ON condition and is compelled to mount the power supply 33 to the apparatus case 36 after switching the switch 34 to the position of OFF condition to turn OFF the power supply 33.

According to such an arrangement, as with the embodiments 1 and 2 mentioned above, forgetting the return of the switch 34 of the power supply 33 can be prevented, thus enabling the interruption of communication with the main body of the printer, and preventing a wasteful consumption of power and a shortened service life of electric parts such as power supply.

In the above mentioned embodiments, a description was made by exemplifying an application of the present invention to a deck as sheet processing device, but the present invention is not limited to this arrangement. For example, a switch lever 39 according to Embodiment 2 may be provided on the plane connected to the main body 14 of the printer of a finisher 29. And, by so arranging a switch lever 39 as capable of turning ON on disconnecting the finisher 29 from the main body 14 of the printer and a switch 38 as to be switched to OFF on connecting it to the main body 14 of the printer, the present invention is also applicable to other sheet processing devices such as finisher 29.

In the above mentioned embodiments, a printer is exemplified as image forming apparatus, but the present invention is not limited to this. For example, other image forming apparatuses such as copier and facsimile apparatus may be employed and a similar effect can be obtained by applying the present invention to a sheet processing device linked to such image forming apparatuses.

Additionally, in the above mentioned embodiments, the electrophotographic system is the exemplified recording system, but the present invention is not limited to this. For example, other recording systems such as ink-jet system may be employed.

What is claimed is:

1. An image forming apparatus with a sheet processing device attached to a main body of said image forming apparatus, said sheet processing device comprising:

a driving source for actuating said sheet processing device;

a power supply for supplying power to said driving source; and a switch for changing said power supply to ON/OFF;

wherein said switch becomes a condition that said switch can be turned ON when an outer cover of said sheet processing device is detached and said switch is turned OFF when the outer cover is attached.

2. The image forming apparatus according to claim 1, said switch including:

a slide switch slidable between ON and OFF conditions of said power supply; and a switch lever for sliding said slide switch by rotation in response to attachment/detachment of said outer cover to/from said sheet processing device.

3. The image forming apparatus according to claim 2, wherein said switch lever has a slit into which said slide switch is inserted and said slide switch slides while guided by said slit by the rotation of said switch lever.

4. The image forming apparatus according to claim 2, wherein said switch lever protrudes outwardly from an attaching position of said outer cover when said outer cover is detached and said switch is turned ON condition and said switch lever is pushed by said outer cover to become OFF condition when said outer cover is attached.

5. The image forming apparatus according to claim 2, wherein said slide switch is OFF condition in ¾ range of a stroke in a sliding direction and is ON condition in remaining ¼ range.

6. An image forming apparatus provided with a sheet processing device detachably attachable to a main body thereof, said sheet processing device comprising:

a driving source for actuating said sheet processing device;

a power supply for supplying power to said driving source; and a switch for changing said power supply to ON/OFF;

wherein said switch can turn ON said power supply when said sheet processing device is detached from the main body of said image forming apparatus and said switch is turned OFF when said sheet processing device is attached to the main body of said image forming apparatus.

7. The image forming apparatus according to claim 6, said switch including:

a slide switch slidable between ON and OFF conditions of said power supply; and a switch lever for sliding said slide switch by rotation in response to attachment/detachment of said sheet processing device to/from said image forming apparatus.

8. The image forming apparatus according to claim 7, wherein said switch lever has a slit into which said slide switch is inserted and said slide switch slides while guided by said slit by the rotation of said switch lever.

9. The image forming apparatus according to claim 7, wherein the main body of said image forming apparatus is placed on the top of said sheet processing device, and said switch lever protrudes upwardly from the top face of said sheet processing device when the main body of said image forming apparatus is detached causing said switch lever to turn said switch to ON condition, and said switch lever is pushed by the main body of said image forming apparatus and said switch is turned to OFF condition when the main body of said image forming apparatus is attached.

10. The image forming apparatus according to claim 9, wherein a butt surface for pushing said switch lever down is provided at the bottom face of the main body of said image forming apparatus.

11. An image forming apparatus with a sheet processing device attached to a main body of said image forming apparatus, said sheet processing device comprising:

a driving source for actuating said sheet processing device;

a power supply for supplying power to said driving source; and a switch for changing the power supply to ON/OFF;

wherein said power supply is provided detachably to the main body of said sheet processing device, said switch can turn said power supply to ON condition when said power supply is detached and said power supply can be mounted on the main body of said sheet processing device when said switch of said power supply is changed to OFF.

12. The image forming apparatus according to claim 11, wherein said switch has a slide switch slidable between ON and OFF conditions of said power supply, a switch lever for sliding said slide switch by rotation and means for allowing said power supply to be mountable to the main body of said sheet processing device when said switch lever is so positioned that said slide switch is switched to OFF condition.

13. The image forming apparatus according to claim 12, wherein said means for allowing said power supply mountable to the main body of said sheet processing device is provided on the main body of said sheet processing device and has a hole to which said switch lever is insertible at a position where said switch lever turns said slide switch is switched to OFF condition.

14. The image forming apparatus according to any one of claims 1 to 13, wherein said sheet processing device is a sheet feeding device for containing and successively feeding recording sheets to an image forming means provided on the main body of said image forming apparatus.

15. The image forming apparatus according to any one of claims 1 to 13, wherein said sheet processing device is a finisher for stacking sheets with an image formed thereon and discharged from the main body of said image forming apparatus.

* * * * *

UNITED STATES PATENT AND TRADEMARK OFFICE

CERTIFICATE OF CORRECTION

PATENT NO. : 6,088,553

DATED : July 11, 2000

INVENTOR(S): TAKASHI KUWATA, ET AL.

It is certified that error appears in the above-identified patent and that said Letters Patent is hereby corrected as shown below:

COLUMN 5:

Line 33, "know" should read --knob--.

COLUMN 10:

Line 12, "supply" should read --supply to be--.
Line 15, "to" should read --into--, and "insertible" should read --insertable--.
Line 16, "position where" should read --when-- and "turns" should read --is so positioned that--.

Signed and Sealed this

Eighth Day of May, 2001

*Attest:*

Nicholas P. Godici

NICHOLAS P. GODICI

*Attesting Officer*

*Acting Director of the United States Patent and Trademark Office*